US006840024B2

(12) United States Patent
Ronchi

(10) Patent No.: US 6,840,024 B2
(45) Date of Patent: Jan. 11, 2005

(54) DEVICE FOR RAPID ENGAGEMENT/ RELEASE OF UNITS FOR FITTING LIDS TO CONTAINERS

(75) Inventor: Cesare Ronchi, Cassina de'Pecchi (IT)

(73) Assignee: Ronchi Mario S.p.A., Gessate (IT)

( * ) Notice: Subject to any disclaimer, the term of this patent is extended or adjusted under 35 U.S.C. 154(b) by 247 days.

(21) Appl. No.: 10/094,750

(22) Filed: Mar. 11, 2002

(65) Prior Publication Data

US 2002/0139165 A1 Oct. 3, 2002

(30) Foreign Application Priority Data

Mar. 30, 2001 (IT) ..... MI2001A0691

(51) Int. Cl.[7] ..... B65B 7/28

(52) U.S. Cl. ..... 53/329; 53/317; 53/331; 53/331.5

(58) Field of Search ..... 53/329, 317, 331, 53/331.5

(56) References Cited

U.S. PATENT DOCUMENTS 3,031,822 A * 5/1962 Dimond ..... 53/317
4,267,683 A * 5/1981 Harrington ..... 53/331.5
5,417,031 A 5/1995 Bankuty et al.
6,216,340 B1 * 4/2001 Fassbind et al. ..... 29/773

FOREIGN PATENT DOCUMENTS

| | | |
|---|---|---|
| EP | 0 572 107 | 12/1993 |
| EP | 0 850 872 | 7/1998 |
| GB | 2 332 195 | 6/1999 |

* cited by examiner

*Primary Examiner*—Stephen F. Gerrity
(74) *Attorney, Agent, or Firm*—Herbert Dubno

(57) ABSTRACT

A device for rapid engagement/release of units for fitting lids to containers, has a fixed part and a movable part which can be reversibly coupled to the fixed part. The fixed part houses corresponding first radial elements integral with the movable part and such as to allow the movement in an axial and/or radial direction of the movable part. A first locking device is associated with the fixed part and able to co-operate with corresponding second radial elements of the movable part so as to prevent displacement in an axial direction thereof. A second locking device is coaxially movable on the fixed part and able to co-operate with said first radial elements so as to prevent the rotation of the movable part.

15 Claims, 2 Drawing Sheets

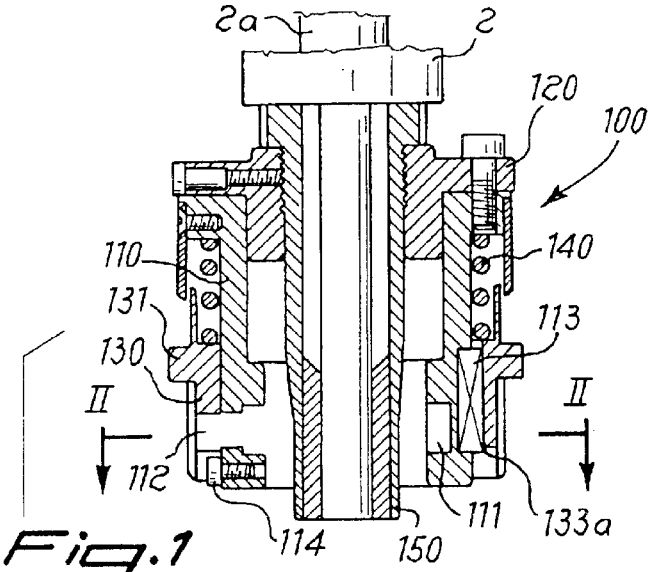
Fig.1
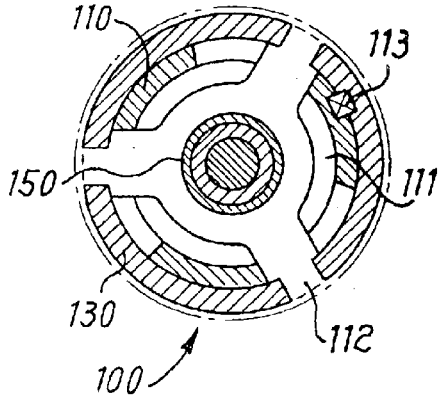
Fig.2
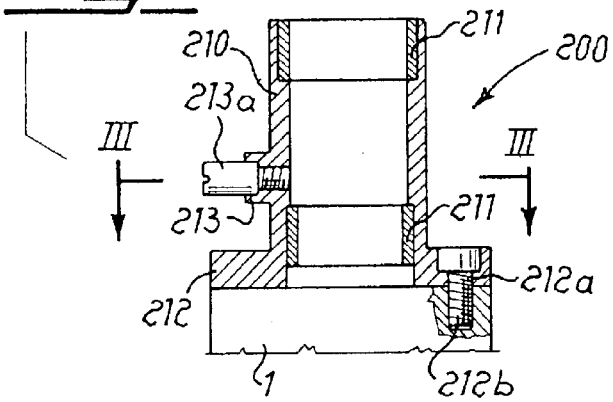
Fig.3
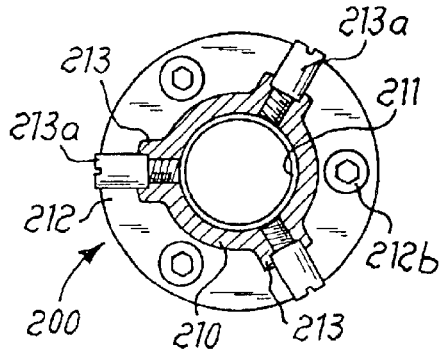
Fig.4a
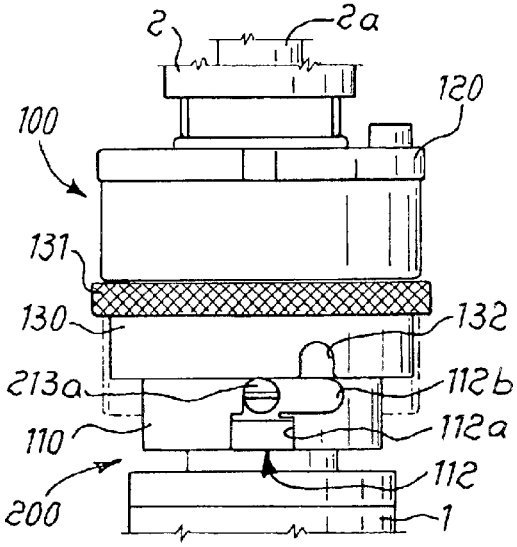
Fig.5a
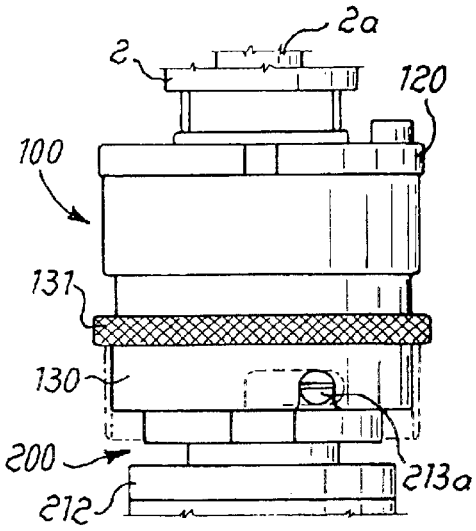

DEVICE FOR RAPID ENGAGEMENT/ RELEASE OF UNITS FOR FITTING LIDS TO CONTAINERS

FIELD OF THE INVENTION

The present invention relates to a device for rapid engagement/release of units for fitting lids to containers, intended in particular for spindles of automatic machines. It is known in the technical sector relating to the packaging of containers such as bottles and the like that there exists the need to fit the sealing lid of the container after the latter has been filled.

BACKGROUND OF THE INVENTION

It is also known that this operation is performed by means of automatic machines comprising several stations where the spindles which receive the lid fitting units are located. Owing to the diversity of the various types of containers with the associated lid, however, it is necessary to provide spindles where the lid fitting unit is specific for each type of lid to be fitted. Such units must therefore be replaced whenever there is a variation in the type of lid being used and with the machine stopped. EP 0,850,872 also discloses a rapid engagement/release device which comprises at least one sleeve which is fixed to the spindle and on which there are coaxially mounted at least one bell which is integral with said sleeve and at least one bush which is partially sealingly inserted inside said bell so as to form a chamber and able to be displaced coaxially with respect to the latter by the thrusting action of resilient means and a fluid under pressure which can be supplied upon actuation to the chamber.

Although performing its function, the known device requires the supply of a fluid under pressure with the consequent need to provide corresponding apparatus for producing said supply and feed means able to convey the fluid inside the spindle, thereby resulting in constructional complications and an increase in the costs and the maintenance operations.

OBJECTS OF THE INVENTION

It is the principal object of the invention, therefore, to provide a device for rapid attachment of lid fitting units to spindles of automatic container sealing machines, which allows rapid and easy manual change-over of the said unit in safe conditions and with the machine stopped, allowing a reduction in the processing cycle idle time.

Another object is that the device should be easy and inexpensive to manufacture and should be able to be adapted to the machines of the known type without the need for additional parts and/or complicated coupling elements and which allows locking/release without the need for auxiliary elements, such as fluids under pressure and the like, so as to ensure locking in position of the device and release for replacement thereof.

SUMMARY OF THE INVENTION

These objects are achieved according to the present invention by a device for rapid engagement/release of units for fitting lids to containers, comprising a fixed part and a movable part which can be reversibly coupled to the fixed part, the fixed part comprising means for housing corresponding first radial elements integral with the movable part and such as to allow the movement in an axial and/or radial direction of the said movable part. First locking means associated with the fixed part and able to co-operate with corresponding second radial elements of the movable part so as to prevent the displacement in an axial direction of the latter. Second locking means are coaxially movable on the fixed part and able to co-operate with said first radial elements so as to prevent the rotation of the movable part.

BRIEF DESCRIPTION OF THE DRAWING

Further details may be obtained from the following description of an embodiment of the invention provided with reference to the accompanying drawing in which:

FIG. 1 is an axial sectional view of the two parts of the rapid engagement device separated from each other;

FIG. 2 is a cross-section along the plane indicated by the line II—II in FIG. 1;

FIG. 3 is a cross-section along the plane indicated by the line III—III in FIG. 1;

FIGS. 4*a*,4*b*,4*c* show respectively an elevational view, an axial section and a cross-section of the device in the condition where the lid fitting unit is inserted/extracted; and FIGS. 5*a*,5*b*,5*c* show respectively an elevational view, an axial section and a cross-section of the device in the condition where the lid fitting unit is locked/released.

SPECIFIC DESCRIPTION

Figure 4B:
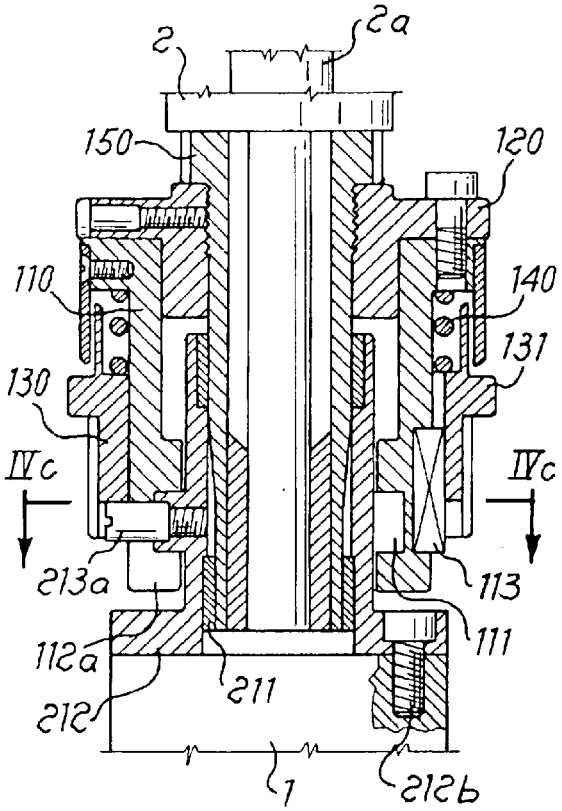
Figure 5B:
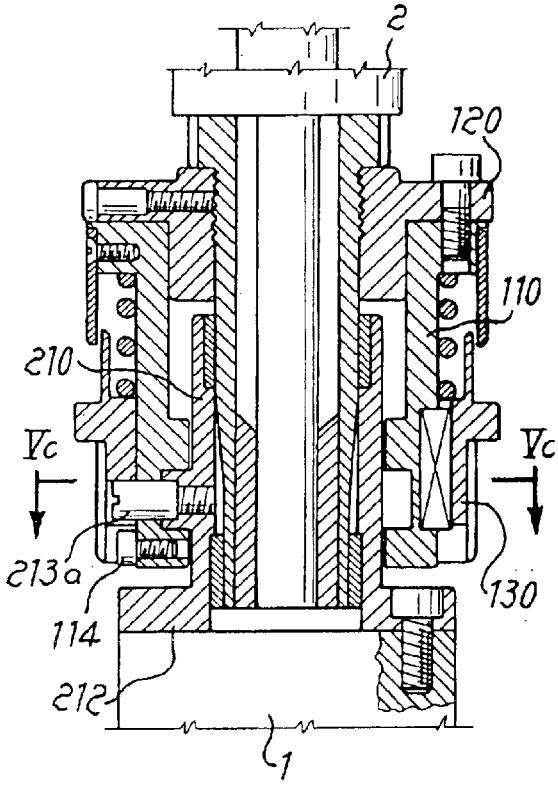
Figure 4C:
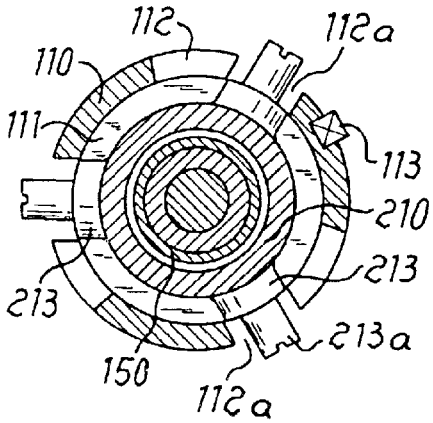
Figure 5C:
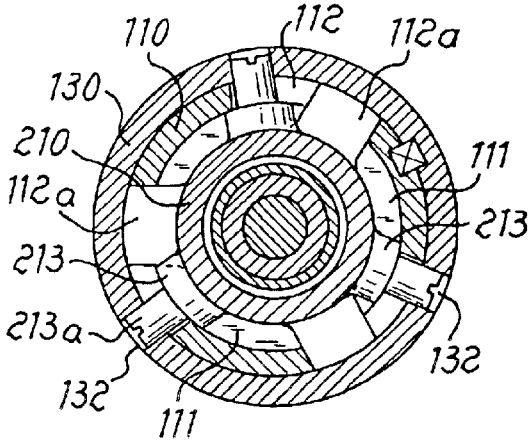

As illustrated, the device for rapid engagement of lid fitting units 1 with spindles 2 of filling machines which are known per se and only schematically shown as the actuator 2*a* for moving the said spindle 2, comprises a first fixed part 100 to be fitted, in a reversible manner, to the spindle 2 and a second interchangeable part 200 which can be rapidly attached to and released from the said first part 100.

In greater detail, the fixed part 100 is formed by a cylindrical body 110 having a top end integral with a circular flange 120 equipped with associated means for fastening to the spindle 2.

At the opposite end to said flange the cylinder 110 has an internal annular seat 111 and shaped recesses 112 composed of a first section 112*a* (FIG. 4*a*) extending in the axial direction and a second section 112*b* extending in the circumferential direction.

The first section 112*a* is open at the bottom end of the cylinder 110 so as to allow the entry, in the axial direction, of a guide element which is described more fully below.

The external surface of the cylindrical body 110 is also provided with a key 113 extending in the axial direction and able to engage with a corresponding seat 133*a* of a ring nut 130 which. can be coaxially mounted on the first cylindrical body 110 and is movable coaxially with respect thereto.

In particular, the ring nut 130 has an annular rim 131 with a diameter greater than the ring nut itself and able to form a stop surface for retaining one of the two ends of a spring 140 which is coaxially mounted on the cylindrical body 110 and other end of which reacts against the said upper flange 120.

On the opposite side to said annular rim, the ring nut 130 has seats 132 extending in the axial direction, the purpose of which will become clearer below in relation to coupling with the movable part 200.

The external surface of the cylindrical body 110 is also provided with radial means 114 able to lock the movement of the ring nut 130 in the axial direction, preventing it from coming out of the said body.

In a preferred embodiment, a tubular element 150 able to form a guide and a stop preventing the movements about the longitudinal axis of the movable part 200 is coaxially located inside the fixed part 100.

Said movable part 200 in turn consists of a cylindrical sleeve 210 with a diameter such as to allow the coaxial insertion into the fixed part 100.

The sleeve 210 has inside it two bushes 211 able to be mounted, substantially without play, onto the said tubular guide element 150.

The bottom end of the sleeve 210 is integral with a flange 212 provided with holes 212*a* for receiving screws 212*b* suitable for fixing the lid screwing element 1.

Quadrangular projections 213 are formed on the external surface of the sleeve 210, and at a suitable axial distance from said flange 212, said projections extending in a radial direction and housing pins 213*a* which protrude radially therefrom.

Said projections 213 are able to co-operate with the annular groove 111 inside the cylindrical body 110, while the pins 213*a* are designed to penetrate into the seat 112 of the said body and into the groove 132 of the ring nut 130 as will emerge more clearly below in connection with operation of the device.

The operating principle of the device for rapid engagement/release of the lid fitting unit is as follows:

in the working condition, the part 100 is fixed to the spindle 2 and the ring nut 130 is axially pushed downwards by the action of the spring 140;

in order to mount the interchangeable part 200, which is normally already provided with the associated gripping element for fitting a specific lid, the entire part 200 is positioned so as to bring the radial pins 213*a* opposite the opening of the axial seat 112*a* of the cylindrical body 110;

the said pins are inserted in the axial direction into the said axial seat section 112*a* and a pressure is exerted in the axial direction so as to overcome the thrusting action of the spring 140, causing retraction, in the axial direction, of the ring nut 130 which thus frees the circumferential section 112*b* of the recess 112 and allows rotation of the sleeve 210 and therefore the pins 213*a* which penetrate into the circumferential section 112*b* and also of the radial projections 213 which rotate inside the annular seat 111 inside which they are retained axially;

the rotation of the sleeve 210 terminates when the radial pins 213*a* are located in an angular position axially aligned with the recess 132 of the ring nut 130, allowing the latter to be released axially downwards as a result of the thrusting action of the spring 140;

this lowering movement of the ring nut 130 prevents the rotational movement of the movable part 200 with respect to the fixed part 100, resulting in locking thereof.

If the unit 100 must be replaced, it is sufficient to perform the sequence in the reverse direction, acting manually on the ring nut 130 so as to raise it in the axial direction and free the pins 213*a* so as to allow the rotational movements and displacement in the axial direction resulting in extraction of the movable part 200 from the fixed part 100.

It is envisaged that the spring 140 has a limited tension since, on the one hand, it must only apply an additional force assisting the force of gravity in order to cause the downward movement of the ring nut 130 and, on the other hand, it must allow raising thereof by means of a manual action performed by any user.

It is envisaged moreover that one of said radial projections 213 has a circumferential dimension greater than that of the other projections and that one of the axial seats 112*a* of the fixed part 100 has a circumferential dimension which is correspondingly greater so as to be the sole one able to allow axial insertion of the larger-size projection and thus ensure precise angular positioning of the movable part 200 with respect to the fixed part 100.

It can therefore be understood how the rapid engagement/release device according to the invention allows change-over of the screwing tool in a rapid and reliable manner; in addition the device allows the mounting of the movable part without the need for releasing one's grip thereon, a feature which is of importance in the specific sector owing to the weight and dimensions of the means for gripping and maneuvring the lid to be screwed.

What is claimed is:

1. A device for rapid engagement/release of a unit for gripping and fitting lids to containers for a spindle of an automatic filling machine, said device comprising a fixed part which can be fastened to the spindle and a movable part which can be reversibly coupled to the fixed part along a common axis of said parts, said fixed part comprising means for housing corresponding first radial elements integral with the movable part and able to allow movement in an axial and/or circumferential direction of the said movable part first locking means associated with the fixed part and able to co-operate with corresponding second radial elements of the movable part so as to prevent the displacement in an axial direction thereof, and second locking means coaxially movable on the fixed part and able to co-operate with said first radial elements so as to prevent the rotation of the movable part.

2. The device according to claim 1 wherein said fixed part comprises a cylindrical body having a top end integral with a circular flange provided with associated means for fastening to the spindle.

3. The device according to claim 2, wherein said housing means a shaped recess formed by a first section extending in the axial direction and open at the free end of the cylindrical body and by a second section connected to the first section and extending in the circumferential direction within the cylindrical body.

4. The device according to claim 2, wherein said first locking means consist of an internal annular seat at the end of the cylindrical body opposite to that of said flange.

5. The device according to claim 2, wherein said second locking means comprise a ring nut coaxially mounted on the cylindrical body and coaxially movable thereon in two opposite directions, said ring nut being provided with seats extending in the axial direction and able to contain a respective first radial element of the movable element.

6. The device according to claim 2, which comprises resilient means located between said fixed part and said second locking means and able to produce an axial thrust on the latter.

7. The device according to claim 6 wherein said resilient means consist of a spring.

8. The device according to claim 6 wherein an external surface of the cylindrical body is provided with means for stopping the displacement of said ring nut, arranged on an opposite side to that of the resilient means.

9. The device according to claim 2, wherein said movable part consists of a sleeve which can be coaxially inserted inside the cylindrical body of the fixed part.

10. The device according to claim 1 wherein a tubular element able to form a guide for the movable part is coaxially located inside the fixed part.

11. The device according to claim 10 wherein bushes able to be mounted on the said tubular element are coaxially arranged inside said sleeve so as to maintain the coaxial arrangement of the movable part with respect to the fixed part.

12. The device according to claim 10 wherein said first radial elements integral with the movable part consist of radial pins.

13. The device according to claim 10 wherein said second radial elements of the movable part consist of substantially quadrangular projections protruding radially from the cylinder of the movable part.

14. The device according to claim 13 wherein one of said quadrangular projections has a circumferential dimension larger than the corresponding dimension of the other projections.

15. The device according to claim 14 wherein one of said axial seats of the cylindrical body has a circumferential dimension corresponding to that of the projection with a larger dimension.

* * * * *